United States Patent [19]

King

[11] 4,164,731

[45] Aug. 14, 1979

[54] ELECTRICAL COMMUNICATION SIGNALLING DEVICE

[76] Inventor: Harold R. King, Rt. 7, Box 223, Easley, S.C. 29640

[21] Appl. No.: 833,431

[22] Filed: Sep. 15, 1977

[51] Int. Cl.[2] ..... G08B 25/00

[52] U.S. Cl. ..... 340/286 R; 340/287

[58] Field of Search ..... 340/286 R; 200/1 B, 200/286

[56] References Cited

U.S. PATENT DOCUMENTS

| | | | |
|---|---|---|---|
| 2,134,323 | 10/1938 | Beach | 200/1 B |
| 3,212,080 | 10/1965 | Gurian | 340/286 |
| 3,555,229 | 1/1971 | Britton | 200/286 |
| 3,599,199 | 8/1971 | Bunting | 340/286 |
| 3,651,512 | 3/1972 | Summers | 340/286 |
| 3,842,223 | 10/1974 | Bird | 200/286 |

*Primary Examiner*—Harold I. Pitts

*Attorney, Agent, or Firm*—Bailey, Dority & Flint

[57] ABSTRACT

An electrical signalling device for a nurse call electrical communication system comprises a switch box, switch means carried by the switch box for activating a call signal at the nurse station, and a manually operable actuator member carried by the switch box for actuating the switch means. An audible signal means is connected to the switch means for producing an audible signal at the bed location in response to actuation of the switch means and immediately after activation of the call signal. An adjustable biasing means is provided for adjusting the amount of force necessary for applying the actuator member to actuate said switch means.

10 Claims, 3 Drawing Figures

ELECTRICAL COMMUNICATION SIGNALLING DEVICE

BACKGROUND OF THE INVENTION

It is typical in hospitals and the like to utilize an electrical communication system between the patient's room and a nurse station whereby a bed patient may activate a call signal for an attendant at the nurse station. These systems normally include a visible and/or audible signal at the nurse's station which is connected in a latching circuit having a power source and a latching relay. A manual switch is provided in the patient's room and is connected to the latching circuit by means of a coaxial cable. When the switch is actuated, the latching circuit is latched on so that the call signal light is activated until the attendant resets the latching circuit.

U.S. Pat. No. 1,559,312 discloses an electrical signal switch and receptacle wherein a pushbutton switch at the bed location may be utilized to activate a series of visual and audible signals at a remote location. The switch is of the conventional pushbutton type. Switches of this type are difficult and sometimes impossible to activate by certain types of bed patients due to their condition and degree of immobility.

U.S. Pat. No. 1,492,686 discloses a pushbutton type switch for signalling an attendant at a remote location wherein a visible signal is indicated at a reset button until the switch is reset by unlatching the switch circuit.

British Pat. No. 453,355 discloses another system and signalling device for fitting in one room to call a person in another. A visual signal is utilized to call the person and an audible signal may be provided adjacent a bank of lights to draw attention to the setting up of a visual signal.

SUMMARY OF THE INVENTION

It has been found that an electrical signalling device can be had according to the invention for a nurse call communication system of the type wherein an attendant at a nurse station is called from a remote bed location by manual actuation of an electrical switch by the bed patient which activates a call signal at the nurse station. The electrical signalling device is provided by a switch box, switch means carried by the switch box for activating the call signal, and a manually operable actuator member carried by the switch box for actuating the switch means. An audible signal means is connected to the switch means for producing an audible signal at the bed location in response to the actuation of the switch means. In a preferred form, the switch means includes a first switch for actuating the call signal and a second switch for actuating the audible signal wherein the first and second switches are arranged in their relative positions so that the second switch is actuated immediately after the first switch. Thus the bed patient is given assurance by the audible signal that the call signal to the nurse's station has been sent. The audible signal also will notify an attendant who is in the immediate area but is not at the nurse's station to see the visual call signal. Adjustable biasing means are provided for adjusting the amount of force necessary for applying the actuator means to actuate the switch means so that the sensitivity of the actuator member may be adjusted to accommodate the mobility conditions of different types of bed patients.

Accordingly, an important object of the present invention is to provide an electrical signalling device for use in an electrical communication system for calling a nurse from a remote bed location wherein a nurse call signal is first produced and then a patient audible signal is produced immediately thereafterwards to give assurance to the bed patient that the nurse call signal has been sent.

Another important object of the present invention is to provide an improved electrical signalling device of the type utilized by a bed patient for activating a nurse call wherein the switching function of the signalling device may be adjusted in its sensitivity to prevent accidental actuation by a highly active bed patient while being adjustable to permit actuation by only a very slight movement by a highly immobilized patient.

Still another important object of the present invention is to provide an electrical signalling device having an audible signal for assuring the bed patient that a visual signal has been sent to a remote nurse station wherein the audible signal is self-contained and requires little or no additional equipment or wiring to be utilized with a present nurse call system.

Still another important object of the present invention is to provide an electrical signalling device for use in a nurse call system having an improved switch actuation member and an adjustable biasing plunger for engaging the actuator member and adjusting the amount of force necessary for applying the actuator member to actuate the nurse call switch.

Still another important object of the present invention is to provide an improved electrical signalling device which may be utilized with almost any of the present nurse call systems with no change necessary in the wiring of the present nurse call system.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
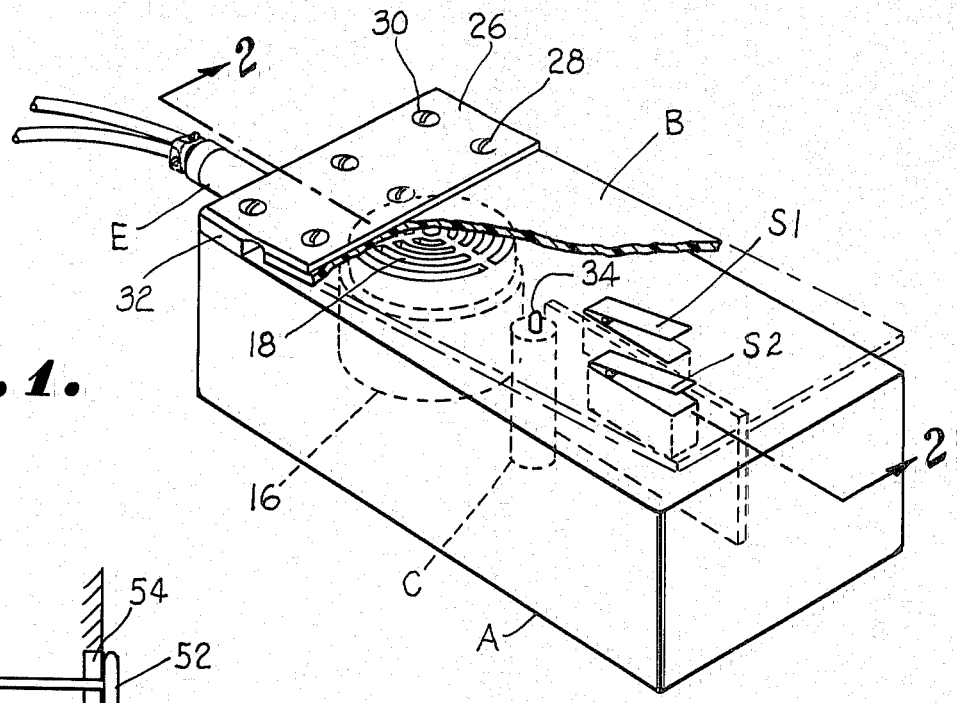
FIG. 1 is a perspective view illustrating an electrical signalling device constructed in accordance with the present invention.

The invention relates to an electrical communication system particularly of the type wherein an attendant at a nurse's station is called from a remote bed location by manual actuation of a switch by the bed patient which activates a call signal at the nurse station. It is common practice is hospitals and the like to utilize a nurse calling system whereby a patient utilizes an electrical signalling device at the bed to activate the call signal at the nurse station. The nurse station normally includes a monitor having a visual call signal display indicating the room or location of the bed patient. Actuation of the switch by the bed patient typically causes an indicator light to be illuminated on the nurse station monitor. In particular, the invention provides an improved electrical signalling device for activating a call signal at a nurse station and an audible signal at the bed location for assuring the patient that the call signal has been sent as well as providing an adjustable and more sensitive switching device.

As illustrated, the signalling device comprises a switch box A which is preferably a four-sided, closed bottom plastic box having an open top into which a planar face plate 10 is integrally affixed following assembly of the internal components. A switch means is provided by a pair of microswitches S1 and S2 for activating the signals produced by the signalling device. An audible signal means is connected to the switch means for producing an audible at the bed location in response to actuation to the switch means. A manually operable actuator member B is carried by the switch box for actuating the switch means comprising S1 and S2. An adjustable biasing means C is provided for adjusting the amount of force necessary for applying to actuator member B by the patient to actuate the switch means.

The switches S1 and S2 are preferably conventional microswitches each having a switch arm 12 and closure member 12*a* which closes the microswitch circuit and a pair of leads 14. Switch S1 activates the call signal at the nurse station and switch S2 activates the audible signal means described below. The switches S1 and S2 as carried by affixation to a vertical mounting plate 15 which is integral with face plate 10. The switches may be glued to plate 15 or attached by use of nylon screws. The microswitches provide highly advantageous results when combined with the actuator plate B and the adjustable biasing means C to afford a high degree of sensitivity to the switch which may be actuated by the most severly immobilized patient.

The audible signal means includes a buzzer 16 carried within the switch box A, a power source D for energizing the buzzer 16 and the microswitch S2 connected in a series circuit. The buzzer 16 is preferably affixed to the face plate 10 in any suitable manner such as by gluing and the face plate is provided with a grill 18 through which the sound of the buzzer may be emitted. The buzzer may be of conventional construction and one suitable type is manufactured by the P. R. Mallory Co., Inc. as Model No. Sc628 which emits a continuous high frequency buzz which is readily audible yet is not offensive to the hearing. The power supply D includes a three-prong plug for insertion into a standard AC wall receptacle and a voltage step-down transformer 22 for stepping the voltage down from 120 to approximately 6.3 volts. A full wave rectifier 24 is provided for converting the stepdown voltage to a direct current voltage of approximately 6 volts.

The actuator member B is preferably a plate of tinted plexiglass and is affixed to the switch box A by means of a resilient hinge 26 provided by a flexible plastic material. The plate B is attached to the hinge 26 by means of nylon screws 28. The hinge is affixed to the switch box A by means of nylon screws 30 which are affixed to a raised bridge plate 32 to space the plate B in a superposed position above the switching face 10. The resilient hinge 26 maintains the actuator plate B in close proximity with the switch arms of the microswitches S1 and S2 while preventing it from pivoting too far away from an immediate actuating position.

The adjustable biasing means C includes a spring biased plunger 34 biased upwardly by a spring 36 whose biasing force may be adjusted by turning a threaded plug 38 threadably received in a plastic tube 40. Access to the plug 38 may be had through an opening 42 in the bottom of switch box A.

Figure 2:
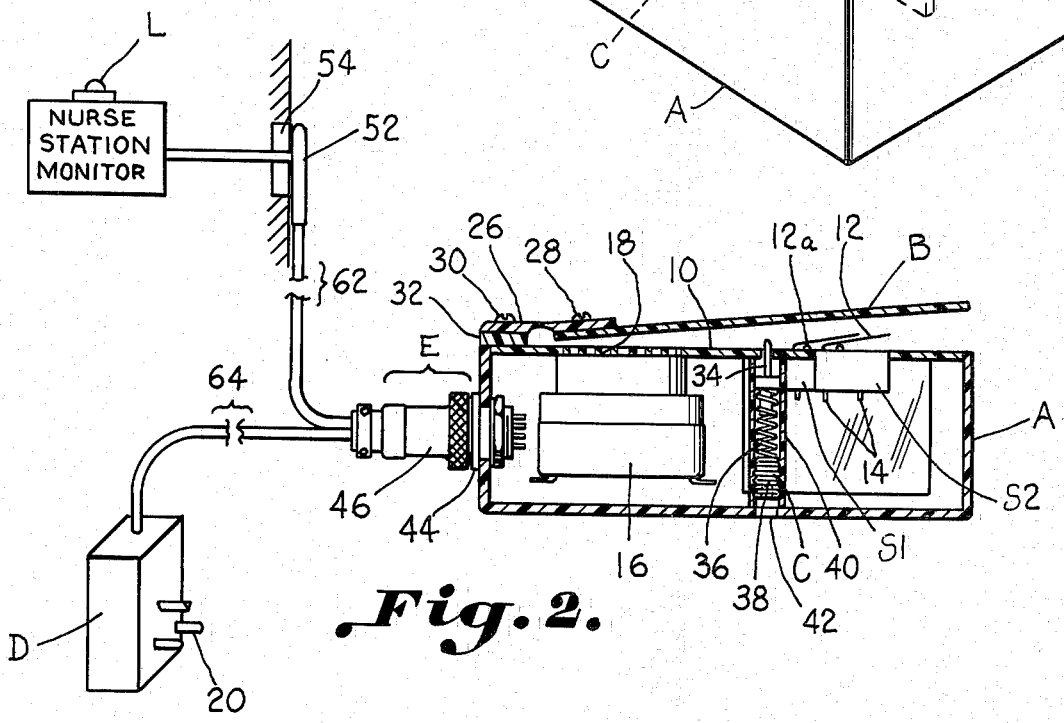
FIG. 2 is a sectional view of the signalling device of FIG. 1 taken along line 2—2 and a schematic diagram showing its use in an electrical communication system of the type for calling a nurse from a remote bed location.

In order for the actuator plate B to depress the switch arms of the microswitches S1 and S2 for actuation, it normally must overcome the biasing force of the plunger 34. In other words, more or less force may be required to actuate the switches S1 and S2 depending on the amount that the plunger 34 is biased upwardly by the spring 36. In the case of a highly immobilized bed patient, it may be desirable to adjust the plunger so that the plate B actuates the microswitches with little or no force to overcome the spring biased plunger 34. In such a case, the switch means may be activated by the mere slight movement of any part of the body. With the spring biased reduced or removed, the actuator plate B hangs very lightly by the resilient hinge 26 and requires very little force to actuate the microswitches. After actuation, the plate B returns to an out of contact position shown generally in FIG. 2.

In other cases where the bed patient may be highly restless or active, the bed patient may accidentally hit the actuator plate B to actuate the microswitches. In this case, it will be desirable to increase the spring bias on the plunger 34 to require a large force against the plate B in order to actuate the switches. Thus it can be seen that a highly advantageous and improved switching device can be had according to the invention whereby the sensitivity of the switching function of the device may be adjusted to accommodate patients of all types of conditions.

Figure 3:
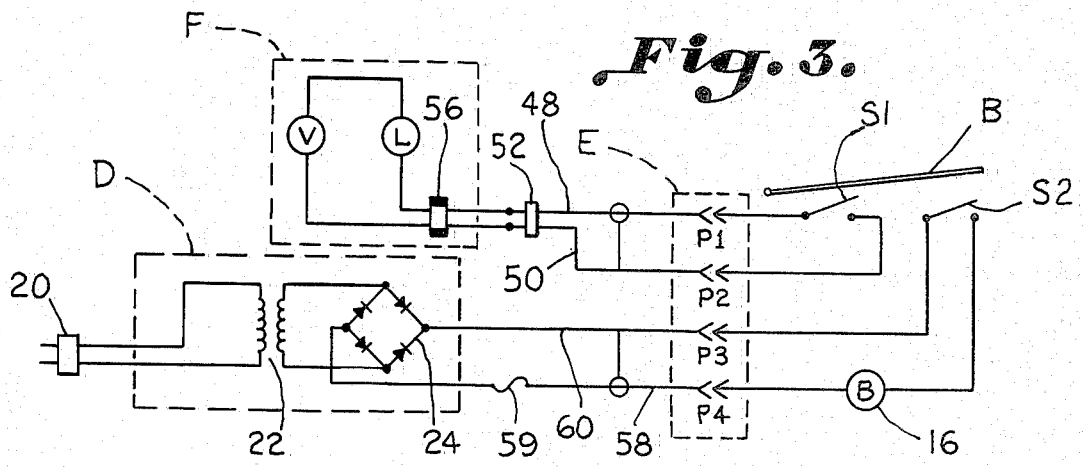
FIG. 3 is a schematic circuit diagram of the electrical signalling device and a nurse call system according to the invention.

Referring now to FIG. 3, a schematic diagram of an electrical circuit for a nurse call system and signalling device according to the invention is illustrated. The switch box A is electrically connected to the power source D and nurse station monitor by means of a pin connector E which includes a four-pin male coupling member 44 carried by the switch box A and a four-socket female coupling member 46 which is inserted into the pin coupling 44. The four pins of the connector E are schematically illustrated in FIG. 3 as P1, P2, P3, and P4. Pin P1 is connected to one terminal of switch S1 and pin P2 is connected to the other terminal of switch S1. The female sockets to which pins P1 and P2 are inserted are connected by electrical leads 48 and 50 through a jack plug 52 to a conventional nurse signalling circuit F. The jack 52 is normally a ¼" monophone jack which fits into a conventional receptacle 54 normally located in a wall of the room of the bed patient which is wired to signal circuit F. The nurse signalling circuit F typically includes a voltage source V, a lamp L, and a conventional latching relay 56. The lamp L is illuminated by the voltage source V when the latching relay 56 is energized by actuation of switch S1 to close a latch across the relay contacts. The latching circuit remains activated and the lamp L is illuminated until the latching relay 56 is reset. This is the most commonly used signalling circuit utilized to send a call signal to a nurse whereby momentary closure of switch S1 latches on the lamp L until the visible call signal is noticed and the relay 56 is manually reset by the nurse or other attendant.

The pin P3 is connected to one terminal of switch S2 and the pin P4 is connected to the other terminal of switch S2 with the buzzer B in series with the switch. The socket members of the female connector are connected by leads 58 and 60 to the terminals of the full wave bridge rectifier 24 of the power source D. Leads 48 and 50 and the leads 58 and 60 are preferably in the form of coaxial cables 62 and 64, respectively. It will readily be seen that closure of switch S2 will place the 6 volt power source D across the buzzer 16 energizing the buzzer 16. A slow-blow fuse 59 is provided for circuit protection.

As illustrated, the microswitches S1 and S2 are staggered in their relative longitudinal positions on the face 10 so that depressing the actuator plate B causes the microswitch S1 to be actuated first latching the circuit F on and activating the call signal light L on the nurse station monitor. Immediately after actuation of switch S1, the actuator plate B actuates switch S2 activating the buzzer 16 and producing an audible signal only as long as the plate B is depressed. Once release of base plate B occurs, the audible signal terminates, however, visual signal L remains on until circuit F is reset in a conventional manner. The time difference between actuation of switches S1 and S2 is almost negligible and in fact virtually instantaneous. However, it can be assured that S2 is actuated only after S1 is actuated and that if S1 is actuated, S2 must be also. Thus, the patient is given an audible signal to indicate that the visible call signal has been activated at the nurse station. This relieves the hospital patient of any anxiety as to whether or not the signal has been sent which is self-assuring to a patient having a critical need. The audible signal may also call a nurse in the vicinity which is not at the nurse station to see the normal visible call signal.

Thus, an advantageous electrical signalling and switching device can be had according to the invention wherein a switch is provided for activating a call signal at the nurse's station and a second switch is provided for activating an audible signal immediately after activation of the call signal to assure the bed patient that the call signal has been sent. The signalling device may be adjusted in its sensitivity so that the force necessary to apply the actuation member for activating the switches may be adjusted according to the need and mobility of the bed patient.

While a preferred embodiment of the invention has been described using specific terms, such description is for illustrative purposes only, and it is to be understood that changes and variations may be made without departing from the spirit or scope of the following claims.

What is claimed is:

1. An electrical signalling device for use in an electrical communication system of the type wherein an attendant at a nurse station is called from a remote bed location by manual closure of a switch by a bed patient at the bed location which activates a call signal at said nurse station, wherein the improvement comprises:

a switch box having a face plate;

switch means carried by said switch box adjacent said face plate for activating said call signal;

a manually operable actuator plate member carried by said switch box in a generally superposed position relative to said face plate for activating said switch means;

adjustable biasing means carried adjacent said actuator plate for adjusting the amount of force necessary for applying said actuator member to actuate said switch means; and said actuator plate being carried on said switch box by means of a resilient hinge about which plate pivots, said resilient hinge biasing said actuator plate slightly out of contact with said switch means, said resiliently hinged plate and adjustable biasing means cooperating to provide highly sensitive switching actuatable by the most severely handicapped bed patient.

2. The apparatus of claim 1 comprising an audible signal means carried in said switch box connected to said switch means for producing an audible signal at said remote bed location in response to actuation of said switch means.

3. The apparatus of claim 2 wherein said switch means includes a first electrical switch for activating said call signal, and a second electrical switch connected to said audible signal means, said second switch being arranged relative to said first switch adjacent said face plate so as to cause said audible signal means to be sequentially activated immediately after actuation of said first switch providing an indication assuring the bed patient that the call signal has been sent.

4. The apparatus of claim 2 wherein said audible signal means comprises a buzzer carried by said switch box and a power source for energizing said buzzer, said switch means being connected in a series therewith.

5. An electrical signalling device for use in an electrical communication system for calling a person at one remote location from another of the type wherein an attendant at a nurse station is called from a remote bed location by manual closure of a switch at the bed location which activates a call signal at the nurse station, said device comprising:

a switch box having a face plate;

switch means carried by said switch box adjacent said face plate for activating said call signal;

a manually operable actuator plate member carried by said switch box generally above said face plate for actuating said switch means;

audible signal means connected to said switch means for producing an audible signal at said bed location in response to actuation of said switch means; and said switch means including a first switch for activating said call signal and a second switch for activating said audible signal, said second switch being disposed adjacent said face plate in staggered switching relation to said first switch, said actuator plate member coextending over said first and second switch for engagement therewith so as to sequentially activate said audible signal immediately after activation of of said call signal.

6. The apparatus of claim 5 including an adjustable biasing means for adjusting the amount of force necessary for applying said actuator member to actuate said switch means.

7. The apparatus of claim 6 wherein said adjustable biasing means includes a spring-biased plunger extending upwardly for engagement against said actuator plate member prior to said actuator plate member engaging said switch means and means for adjusting the biasing force of said spring.

8. The apparatus of claim 5 wherein said actuator plate member is carried on said switch box by means of a resilient hinge about which said plate pivots biasing said actuator plate slightly out of contact with said switch means.

9. In an electrical communication system for calling a person from a remote location of the type wherein an attendant at a remote nurse station is called from a remote bed location by actuation of a switch at the bed location which activates a call signal at the nurse station, an electrical signalling device comprising:

a switch box having a face plate;

switch means carried by said switch box adjacent said face plate for activating said call signal;

audible signal means carried by said switch box connected to said switch means for producing an audible signal at said bed location in response to actuation of said switch means;

a manually operable actuator plate member carried by said switch box coextending above said switch means for actuating said switch means;

adjustable biasing means for adjusting the amount of force necessary for applying said actuator member to actuate said switch means; and said switch means including a first switch for activating said call signal, a second switch for activating said audible signal means, said first and second switches being arranged adjacent said face plate in a staggered relative switching relation so that said actuator plate actuates said second switch immediately after actuation of said first switch providing a signal assuring the bed patient that said cell signal has been sent.

10. The apparatus of claim 9 wherein said actuator plate member includes a hinged plate resiliently hinged to said switch box biasing said actuator plate slightly out of contact with said switch means, said adjustable biasing means being biased against said plate during actuation.

* * * * *